US011459003B2

(12) United States Patent
Roche et al.

(10) Patent No.: US 11,459,003 B2
(45) Date of Patent: Oct. 4, 2022

(54) PROCESS FOR DETECTING A DERAILMENT OF A RAIL VEHICLE

(71) Applicant: Bombardier Transportation GmbH, Berlin (DE)

(72) Inventors: Fabrice Roche, Vienna (AT); Andreas Monarth, Vienna (AT); Guillermo Perez Gomez, Vienna (AT)

(73) Assignee: Bombardier Transportation GmbH, Berlin (DE)

( * ) Notice: Subject to any disclaimer, the term of this patent is extended or adjusted under 35 U.S.C. 154(b) by 336 days.

(21) Appl. No.: 16/616,166

(22) PCT Filed: May 23, 2018

(86) PCT No.: PCT/EP2018/063502
§ 371 (c)(1),
(2) Date: Nov. 22, 2019

(87) PCT Pub. No.: WO2018/215538
PCT Pub. Date: Nov. 29, 2018

(65) Prior Publication Data

US 2020/0231189 A1 Jul. 23, 2020

(30) Foreign Application Priority Data

May 23, 2017 (DE) ..... 10 2017 208 760.9

(51) Int. Cl.
*B61F 9/00* (2006.01)
*B61K 9/00* (2006.01)
(Continued)

(52) U.S. Cl.
CPC ..... *B61F 9/005* (2013.01); *B61K 9/00* (2013.01); *B61L 15/0081* (2013.01); *B61F 5/24* (2013.01); *B61L 25/025* (2013.01)

(58) Field of Classification Search
CPC ..... B61F 9/005; B61K 9/00; B61L 15/0081; B61L 25/025; B61D 13/00
(Continued)

(56) References Cited

U.S. PATENT DOCUMENTS 3,994,459 A 11/1976 Miller et al.
5,640,910 A * 6/1997 Pouyt ..... B61D 13/00 105/168
(Continued)

FOREIGN PATENT DOCUMENTS

DE 2517267 A1 11/1975
DE 2500041 A1 7/1976
(Continued)

OTHER PUBLICATIONS

Fleming, William J., "Overview of automotive sensors", IEEE Sensors Journal, Dec. 2001, pp. 296-308, vol. 1, No. 4.
(Continued)

*Primary Examiner* — Zachary L Kuhfuss
(74) *Attorney, Agent, or Firm* — The Webb Law Firm

(57) ABSTRACT

A process for detecting a derailment of a rail vehicle having two or more rail vehicle parts and one or more articulations through which adjacent rail vehicle parts are rotatably connected with one another includes determining an angle of rotation between adjacent rail vehicle parts, and/or a quantity derived from the angle of rotation. The process further includes comparing the angle of rotation or the derived quantity with at least one reference value or threshold, or with at least one reference value range or threshold range. A test criterion indicating whether or not there is a derailment is defined based on the at least one reference value or threshold, and/or an expected relationship of multiple angles of rotation, and/or an expected relationship of the multiple quantities derived from the angles of rotation, relative to one
(Continued)

another. The method further includes determining whether or not the test criterion is met.

15 Claims, 4 Drawing Sheets

(51) Int. Cl.
*B61L 15/00* (2006.01)
*B61L 25/02* (2006.01)
*B61F 5/24* (2006.01)

(58) Field of Classification Search
USPC ..... 246/173
See application file for complete search history.

(56) References Cited

U.S. PATENT DOCUMENTS

| | | | | |
|---|---|---|---|---|
| 5,880,586 | A | 3/1999 | Dukart et al. | |
| 8,483,892 | B2 | 7/2013 | Gaile et al. | |
| 2007/0279044 | A1 | 12/2007 | Rossmann et al. | |
| 2010/0305788 | A1 | 12/2010 | Walter | |
| 2012/0118194 | A1* | 5/2012 | Schneider | B61F 5/24 105/171 |

FOREIGN PATENT DOCUMENTS

| | | | |
|---|---|---|---|
| DE | 19645982 | A1 | 6/1997 |
| DE | 19837476 | A1 | 2/2000 |
| DE | 102007004522 | A1 | 7/2008 |
| DE | 102007044575 | A1 | 4/2009 |
| DE | 102007054861 | A1 | 5/2009 |
| DE | 19919604 | B4 | 8/2009 |
| DE | 102015203297 | A1 | 8/2016 |
| EP | 0697320 | A1 | 2/1996 |
| EP | 1236633 | A2 | 9/2002 |
| WO | 2012140073 | A1 | 10/2012 |
| WO | 2013124429 | A1 | 8/2013 |

OTHER PUBLICATIONS

Wu, Cheng-Shing et al., "Modified vector rotational CORDIC (MVR-CORDIC) algorithm and architecture", IEEE Transactions on Circuits and Systems II: Analog and Digital Signal Processing, Jun. 2001, pp. 548-561, vol. 48, No. 6.

* cited by examiner

PROCESS FOR DETECTING A DERAILMENT OF A RAIL VEHICLE

CROSS-REFERENCE TO RELATED APPLICATIONS

This application is the United States national phase of International Application No. PCT/EP2018/063502 filed May 23, 2018, and claims priority to German Patent Application No. 10 2017 208 760.9 filed May 23, 2017, the disclosures of which are hereby incorporated by reference in their entirety.

BACKGROUND OF THE INVENTION

Field of the Invention

This invention relates to a process for detecting a derailment of a rail vehicle and a rail vehicle that is set up to carry out this process.

Description of the Related Art

In public transport, derailment of a rail vehicle, for example a streetcar, is, on the one hand dangerous to passengers and other road users, and, on the other hand, it can also damage the vehicle. A derailment can have different causes, for example a collision with a means of transportation, a failure in the rails, a switch, etc. Therefore, it is useful to implement in the vehicle a system that can detect derailment.

WO 2012/140073 A1 proposes a process for derailment monitoring of at least one wheel of a chassis of a rail vehicle, this process involving generating a derailment situation signal representing a derailment situation of the at least one of the wheel, depending on the result of a comparison of signals available in the rail vehicle. A first step involves determining a current rotational speed signal representing a current rotational speed of the at least one of the wheel. A second step involves determining an expected rotational speed signal representing a currently expected rotational speed of the at least one of the wheel, this signal being determined from at least one signal available in the rail vehicle that represents the current travel state of the rail vehicle. A third step involves comparing the current rotational speed signal, in a rotational speed signal comparison, with the expected rotational speed signal, and a fourth step involves generating the derailment situation signal depending on the result of the rotational speed signal comparison.

EP 0 697 320 A1 discloses a device for detecting a derailment of one or more cars traveling on rails, in particular railroad cars of a compound railroad train with a railcar. The cars have arranged on them, at least in the area of an axle equipped with wheels, at least one sensor which can detect the position of the wheels and the axle with respect to the rails and, if this position deviates beyond a specified tolerance value, this sensor emits a signal that can be transmitted, by transmission means, to a central place.

EP 1 236 633 A2 discloses a process for detecting derailed states of wheels of a rail vehicle by determining at least one parameter characteristic of a derailment state, comparing this parameter with at least one specifiable expected value and, if the parameter deviates from the expected value by more than a specifiable amount, triggering a notification signal and/or an emergency braking. In the area of an axle bearing mount of at least one wheel, at least one acceleration signal is produced, and/or at least at two points of a bogie frame the respective longitudinal acceleration is continuously determined and captured in the form of a longitudinal acceleration signal, and/or at least at one wheel axle a rotational speed signal is produced, and the at least one parameter characteristic of a derailment state is determined from the at least one acceleration signal produced in the area of an axle bearing mount, and/or from the longitudinal acceleration signals, and/or from the at least one rotational speed signal.

DE 2 517 267 A1 discloses a device for displaying derailments of a rail vehicle, wherein the rail vehicle has a radio transmitter arranged on it that contains means responding to vertical acceleration as a consequence of derailment of the vehicle and that cause the transmitter to emit a radio signal that is detectable in a receiver, the receiver having means activating an alarm or warning device upon receipt of these radio signals.

SUMMARY OF THE INVENTION

The derailment detection should take into consideration different constraints:

- Different scenarios during travel must be detected;
- Travel conditions (travel speed, dynamic effects of springs, etc., must be taken into consideration;
- False-positive results should be avoided;
- Software implementation should be possible.

The invention has the goal of indicating a derailment detection process that reliably reports a derailment and preferably meets one or more of the above-mentioned criteria.

One fundamental idea of the invention involves analyzing angles between railroad vehicle parts that are rotatable with respect to one another and determining from these angles whether there is a derailment.

The invention is especially applicable to streetcars, but is not limited to them. In the case of a streetcar, the rail vehicle parts are preferably modules of a streetcar. The streetcar is preferably a multiply articulated vehicle.

The inventive concept of derailment detection uses, in particular, articulation angle sensors to detect the position of the vehicle and the position of the rail vehicle parts with respect to one another. This makes it possible, in the case of a multiply articulated vehicle, to detect whether or not a derailment can be present.

It is possible to measure the angles between the rail vehicle parts. The sensors are mounted, for example, in or near the articulations of the rail vehicle and measure the angles, movements, and the change of the angle over time (rotational speed). The measured values or combination of these values make it possible to draw conclusions about whether there is a derailment.

In particular, it is possible to analyze the following factors, this list not being limitative:

- The angles of rotation between rail vehicle parts, in particular articulation angles;
- The rotational angular velocity between rail vehicle parts, in particular in an articulation, also referred to as rotational speed,
- The rotational angular acceleration between rail vehicle parts, in particular in an articulation, also referred to as rotational acceleration;
- Comparison between different, in particular two or more successive articulations, in particular comparison of angles of rotation or rotational angular velocities or rotational angular accelerations;

Comparison between all articulations, in particular comparison of angles of rotation or rotational angular velocities or rotational angular accelerations;

Comparison with data from a reference run (calibration run).

The invention can use the redundancy of the above-mentioned factors, or other factors that are determined on the basis of one or more angles of rotation or data derived therefrom, for reliable detection of a derailment. The more parameters warn of a potential derailment, the more probable it is that there is a derailment.

As a result of the detection, it is possible to output a message to the driver or activate an automatic braking.

The proposed derailment detection concept is characterized by one or more of the following advantages:

Easy to implement, since it is a software evaluation of sensor values;

It can use sensors that are already present on the vehicle. The result is an economical solution, because it does not require mounting additional sensors on the chassis or car body and regularly calibrating them.

It has increased reliability due to the redundancy of criteria.

It is adaptable to different vehicle configurations (different numbers of vehicle parts, length, width . . . ).

In particular, the invention indicates a process for detecting a derailment of a rail vehicle, the rail vehicle having two or more rail vehicle parts and one or more articulations, through which adjacent rail vehicle parts are rotatably connected with one another, this process comprising:

a) Determining a-1) an angle of rotation between adjacent rail vehicle parts, and/or a quantity derived from the angle of rotation; or a-2) multiple angles of rotation between different rail vehicle parts, in particular between adjacent rail vehicle parts, or multiple quantities derived from the angles of rotation;

b) comparing b-1) the angle of rotation or the derived quantity from a-1), or multiple angles of rotation or derived quantities from a-2) with at least one reference value or threshold, or with at least one reference value range or threshold range; and/or b-2) multiple angles of rotation, or the multiple quantities from a-2) derived from the angles of rotation, relative to one another; and/or b-3) a state value that is determined from multiple angles of rotation or multiple quantities from a-2) derived from the angles of rotation, with at least one reference value or threshold, or with at least one reference value range or threshold range a test criterion indicating whether or not there is a derailment being defined on the basis of the reference value, threshold, the reference value range, and/or the threshold range in b-1) or b-3), and/or an expected relationship of multiple angles of rotation, or of the multiple quantities from b-2) derived from the angles of rotation, relative to one another, c) determining whether or not the test criterion is met and whether a derailment is happening or has happened, or is not happening or has not happened.

The process can be carried out while the rail vehicle is traveling or when it is stopped. Although a derailment takes place while the rail vehicle is traveling, it is also possible to check, when the rail vehicle is stopped, whether or not a derailment previously occurred while it was traveling.

Determining an angle of rotation or a quantity derived therefrom means, in particular, determining a value from it.

The angle of rotation can be determined, in particular be measured, at any place in the rail vehicle or rail vehicle parts. The angle of rotation can be an angle of rotation of an articulation, also referred to as an articulation angle. The angle(s) of rotation can be determined at or in an articulation itself, near the articulation, or at another place in the rail vehicle.

The term "different adjacent railroad vehicle parts" means that when multiple angles of rotation are considered, the rail vehicle parts or the pair of rail vehicle parts that are used for this purpose are not always the same ones, but rather different rail vehicle parts or different pairs of rail vehicle parts. That is, to determine a first angle of rotation a first pair of rail vehicle parts is used, and to determine a second angle of rotation a second pair of rail vehicle parts is used. Here it can be provided that the first pair of rail vehicle parts and the second pair of rail vehicle parts have a rail vehicle part in common.

Multiple angles of rotation between different adjacent rail vehicle parts or multiple quantities derived from these angles of rotation can be determined at or near different, preferably successive (and interrupted by a rail vehicle part) articulations.

The angle of rotation can be determined with an angle of rotation measuring device. In a special variant, an angle sensor is provided for this purpose. The use of angle sensors to determine articulation angles in rail vehicles is disclosed in WO 2013/124429 A1. This document also describes various types of angle sensors.

An angle sensor is a sensor that can detect different angles in a certain angular range, which depends on the specification of the sensor. A non-limitative example of an angular range is 0° to ±40°. This makes it possible to detect, within the measurement range of the sensor, an angle that the rail vehicles or rail vehicle parts assume with respect to one another. The angular range within which the sensor can detect angles is preferably continuous. However, using another type of angle sensor it is also possible that the sensor be able to detect discrete angle values with a certain step size within the angular range. In other words, the sensor(s) or the sensor arrangement(s) is/are set up for continuous determination of the angle or for detection of discrete values of an angle with a certain step size.

Angle sensors are known in the prior art and are available with quite different characteristics, for example measurable angular range, resolution, type of output (current, voltage, bus signal, frequency), repeatability, linearity.

The sensor can be, e.g., a potentiometric sensor, a magnetoresistive sensor, a Hall effect sensor that functions according to the electromagnetic Hall effect, an optical sensor, a sensor that functions according to the piezoelectric effect, a capacitive sensor, an inductive sensor, an eddy current sensor designed for measuring distance and/or relative positions, or a sensor that works according to at least one of the mentioned principles of operation and/or according to at least one principle of operation that was not mentioned. In particular, it is also possible to arrange multiple magnetoresistive sensors and Hall effect sensors on a common carrier support, e.g., a microcarrier, similar to a microchip. Optical sensors detect, e.g., one of multiple markings that are formed on the articulation, when the marking moves past, out of sight of the sensor. Another type of optical sensor involves carrying out, e.g., a laser triangulation and/or performing a comparison with a reference light ray, as in the case of an interferometer. Another type of optical sensor detects projected patterns at a place on the articulation.

Angle sensors are described, e.g., in the article by William J. Fleming, "Overview of Automotive Sensors", IEEE Sensors Journal, vol. 1, no. 4, pages 296-308, section C, pages 302/303.

The sensor can measure an absolute angle between rail vehicles or rail vehicle parts, or the sensor can measure a change in angle and apply this change in angle to a reference angle, for example the zero position, so that the angle between rail vehicle parts can be determined.

The sensor can be designed to produce a sequence of signals. A sequence of signals means, in particular, that after a change in the angle by a constant amount (an angle increment), the sensor outputs a signal, so that after a change by one angle increment one signal is produced, after a change by two angle increments two signals are produced, etc. This produces a sequence of signals from which it is possible to determine the number of angle increments, and from that in turn the entire change in angle. Thus, in this invention the term "signal" also comprises a sequence of signals.

The angle sensor can be a contactless angle sensor. The term "contactless" means, in one of its meanings, that the sensor is mounted on a first articulation part and does not touch a second articulation part that is rotatable relative to the first articulation part. For example, a magnetic sensor can be mounted on the first articulation part and a magnet, to which the magnetic sensor reacts, can be mounted on the second articulation part. In another meaning, the term "contactless" means that the sensor has a first and a second element, the first element being mounted on a first articulation part and the second element being mounted an a second articulation part, the first and the second elements of the sensor not touching and the first and the second articulation parts, and the first and the second element of the sensor, being rotatable relative to one another. This means that a relative rotation of the articulation parts can rotate the sensor elements mounted thereon relative to one another.

Preferred examples of contactless angle sensors are magnetic sensors, optical sensors, and inductive sensors. The term "magnetic sensors" refers to sensors that react to the change of a magnetic field in their environment, in particular the change of a magnetic flux. Alternatively, they can also be referred to as "magnetic field-sensitive sensors". Preferred examples of magnetic sensors are Hall effect sensors and magnetoresistive sensors. Contactless magnetic sensors are described, for example, in U.S. Pat. No. 5,880,586 A.

The signal of the sensor is, for example, a voltage or a current output from the sensor. The signal can be processed in an analog signal processing device. Alternatively or additionally, the signal of the sensor can be carried to an analog-to-digital converter and passed on, in the form of a digital signal, to the following signal processing device. The signal processing device is also referred to as a computing unit.

The signal processing device performs an algorithm so that the desired output signal(s) are available at the output of the signal processing device. In the example of an angle sensor, the signal processing device makes angle information available in the form of an analog or digital signal. The angle signal can be fed in to an interface that provides the signal output at external connections or performs other processing of an angle signal.

The signal processing device can be in the form of a digital signal processor (DSP). In the case of an angle sensor, this digital signal processor can also be referred to as a CORDIC (Coordinate Rotation Digital Computer). A possible algorithm is described in the article by Cheng-Shing Wu et al. "Modified vector rotational CORDIC (MVR-CORDIC) algorithm and architecture", IEEE Transactions on Circuits and Systems II: Analog and Digital Signal Processing, vol. 48, no. 6, June 2001, pages 548 through 561.

The signal of the sensor can be amplified in a preamplifier and after that carried to the analog-to-digital converter. At the output of the analog-to-digital converter it is possible to perform digital filtering before the digitized signal is processed in the signal processing device. Such a sequence of events and a special Hall effect sensor are described in US 2007/0279044 A.

A signal processing device can be arranged in various places, for example in the form of a stand-alone structural unit between the sensor and downstream components, such as a signaling bus, a vehicle control unit, a vehicle and train control unit. If the signal of the sensor is digitized, the A/D converter is connected between the sensor and the signal processing device.

The signal processing device is preferably a component of a vehicle control unit (VCU) or a vehicle and train control unit (VTCU), the vehicle control unit, just like a vehicle and train control unit, preferably consisting of multiple controllers, converters, sensors, actuators, and possibly other components connected through bus systems or cables.

The following discussion concerns angles of rotation:

The angle of rotation can be an angle of rotation whose axis of rotation is an X-axis, an angle of rotation about a Y-axis, or an angle of rotation about a Z-axis. In the invention it is also possible to determine these angles of rotation in combination. Preferably, at least the angle of rotation about the Z-axis is determined, the angle of rotation about the Z-axis being the one that describes the rotation when traveling through a curve.

The longitudinal axis of a rail vehicle or rail vehicle part is also referred to as the X-axis. A Y-axis of a rail vehicle or rail vehicle part is transverse to the rail vehicle or rail vehicle part and perpendicular to the X-axis and Z-axis of the rail vehicle/rail vehicle part. The Z-axis is perpendicular to the X-axis and Y-axis, and is vertical when the rail vehicle is located on a straight, level section of track.

The angle of rotation of a rotation about the Z-axis can be defined as the angle between the longitudinal axes (X-axes) of two adjacent rail vehicle parts. When the longitudinal axes of two adjacent articulated rail vehicle parts are aligned, for example on a straight track that is free of curves, then the angle between the longitudinal axes of the rail vehicles or rail vehicle parts is defined as 0°, referred to as zero position. The angle of rotation of a rotation about the Z-axis can be defined to have a positive sign when a front rail vehicle part turns to the right, in the direction of travel, relative to the back rail vehicle part that has an articulated connection with the front rail vehicle part, and defined to have a negative sign when the front rail vehicle part turns to the left, in the direction of travel, relative to the rear rail vehicle part, or vice versa. Analogously, it is possible to assign directional signs to rotational angular velocities.

The articulation is designed to allow rotation at least about the Z-axis. The articulation can be designed so that a rail vehicle or rail vehicle part can also be rotated about its X-axis relative to the adjacent rail vehicle part (rolling motion). The articulation can also be designed so that a rail vehicle part can also be rotated about its Y-axis relative to the adjacent rail vehicle part (pitching motion). Motions about the X-, Y-, and Z-axis can be possible.

The articulation preferably has two articulation parts that are rotatable relative to one another. The one articulation part is, for example, connected with a first rail vehicle part and a second articulation part is connected with a second rail vehicle part. The term "articulation part" refers to any part of the articulation, this part not necessarily being necessary for the articulation function itself. An articulation part can be, for example, a part that only serves for fastening a sensor or magnet. The design of the articulation is not limited in any special way.

A reference value or threshold can be assumed or be determined by a measurement. In a preferred variant, a reference value can be a measurement from a reference run.

A reference value range or threshold range refers to a range between an upper reference value/threshold and a lower reference value/threshold. A range can include the limits of the range.

The inventive comparison can determine, in particular, whether a reference value or threshold is not reached, is reached, or is exceeded, or whether or not an angle of rotation or a derived quantity or a state value lies in the range. Whether or not the test criterion is met depends on how it is defined on the basis of the threshold, reference value, or a range thereof. That is, the test criterion can be met, for example, if a reference value/threshold is either exceeded or reached or is not exceeded, or whether or not a value lies within a reference value/threshold range. This depends on what threshold or reference value or range thereof is taken as a basis, whether the angle of rotation or a derived quantity is used, or what derived quantity is used, or what state value is used.

The process can involve determining an angle of rotation between adjacent railroad vehicle parts multiple times or repeatedly, in particular at a time interval. That is, "determining an angle of rotation between adjacent railroad vehicle parts" can be understood to mean "determining at least one angle of rotation between adjacent railroad vehicle parts". The same can apply to a derived quantity. The same can also apply when determining multiple angles of rotation, or quantities derived therefrom, between various adjacent railroad vehicle parts. That is, for two adjacent railroad vehicle parts it is always possible to determine at least one angle of rotation, or even multiple angles of rotation, in particular at a time interval, between these railroad vehicle parts.

The term "derived quantity" should not be understood in the narrow meaning of a derivative, but rather means any quantity that is obtained from the angle of rotation, for example by any arithmetic operation. Thus, the derived quantity is derived from the angle of rotation that is determined. This also applies in the case when multiple angles of rotation and quantities are derived therefrom are determined. In a special case, a derived quantity can be a quantity in the meaning of a derivative. In one embodiment, the derived quantity is a rotational angular velocity (first derivative of the angle of rotation with respect to time) or a rotational angular acceleration (second derivative of the angle of rotation with respect to time or first derivative of the rotational angular velocity with respect to time).

Depending on whether the process uses an angle of rotation, a quantity derived therefrom, or a state value for comparison, a different threshold or reference value can be taken as a basis. Thus, the process can use different reference values or thresholds, and can even do so simultaneously. For example, it is possible to set or define a first reference value/threshold for the angle of rotation, a second reference value/threshold (range) for the rotational angular velocity, a third reference value/threshold (range) for the rotational angular acceleration, and/or a fourth reference value/threshold (range) for the state value. These reference value/threshold (ranges) can be used in any combination, depending on what combination of angle of rotation, rotational angular velocity, rotational angular acceleration, and/or state value is used in the process.

A state value describes a state of the rail vehicle or parts thereof, that is derived, in particular calculated from multiple angles of rotation or quantities derived therefrom. Any arithmetic operations can be applied, such as, for example, subtraction, addition, multiplication, or division. A special example of a state value is a difference of angles of rotation at successive articulations, this difference being obtained by subtraction, from which it is possible to make a statement about the position of railroad vehicle parts relative to one another. In this example, the position of railroad vehicle parts relative to one another describes a state of the railroad vehicle. Multiplying angles of rotation or rotational angular velocities allows a statement to be made about whether they have the same sign or a different sign, which in turn describes a state of the rail vehicle; for example, if the signs are different this shows that different articulations are deflected in different directions. Analogously, state values can express states involving rotational angular velocities or rotational angular accelerations between railroad vehicle parts.

In one embodiment, the reference value, the threshold, the reference value range, or the threshold range are or have been determined from a reference run of the rail vehicle on an equal section of track, or on the very same section of track. The reference run can be a run that is performed in the way that it is performed, or in the way that it should be performed, in regular travel mode, in particular with the same velocities and accelerations.

An expected relationship expresses a relationship of multiple angles of rotation or multiple quantities derived from the angles of rotation relative to one another, which can be defined in any way. In a special case, this can mean a relative direction (for example, of a rotational angular velocity or rotational angular acceleration), a relative sign (for example of an angle of rotation), a ratio of quantities, or something similar, these examples being provided only for illustration, and not being understood as limitative.

The process can further have one or more of the following steps, in any selection, if it is found that a derailment is occurring or has occurred:

- Producing a derailment situation signal if it has been determined that a derailment is occurring or has occurred.
- Outputting a warning or a distress signal about a derailment;
- Sending a message about the derailment to a control center or a rescue center;
- Emergency braking or other braking of the rail vehicle.

Special variants of the process are described below, which can be used individually or in any combination:

In one embodiment, the threshold, in particular in step b-1), is an angle of rotation matching a minimum radius of a curve, and the test criterion is defined so that the angle of rotation is less than this threshold. The assumption here is that a run is normal when the angle of rotation is less than an angle matching the smallest radius in the railroad network. This angle can be determined from geometric track data and the curve radii determined therefrom.

In another embodiment, the test criterion, in particular in process variant b-1), is defined so that the angle of rotation, or the quantity derived therefrom, is less than the reference value or the threshold. In this case, the derived quantity is, in particular, a rotational angular velocity, that is a change in angle. The assumption is that a run is normal if the angle or the change in angle over time is less than the measurement of a reference run or a threshold. An advantageous variant of this embodiment involves combining it with an embodiment in which the shape of a section of track is determined, as described below. It can be checked whether one or more articulations that are located in a section of track of a certain shape, preferably all articulations in such a section of track, has/have a deflection that lies below a reference value, threshold, or tolerance value. This can involve adapting the reference value, threshold, or tolerance value to the shape of the section of track (according to another embodiment described further below). In particular, if the section of track is straight, the reference value, threshold, or tolerance value can be selected to be very small, since in the case of a straight section of track it is assumed that the articulations located in this section of track have no deflection, that is an angle of rotation of zero, or no rotational angular velocity, it always being possible here to take a small tolerance value as a basis.

In yet another embodiment, value limits of the reference value range are defined as follows:

an upper reference value, which corresponds to a value of an angle of rotation determined during the reference run of the rail vehicle, or a quantity derived therefrom, plus a tolerance value;

a lower reference value, which corresponds to the value of an angle of rotation determined during the reference run of the rail vehicle, or a quantity derived therefrom, minus a tolerance value;

and the test criterion is defined so that the determined angle of rotation or the quantity derived from the determined angle of rotation, lies within the reference value range. The reference value range can include the upper and the lower reference value.

The last-mentioned embodiment is especially applicable to process variant b-1). The variant is, in particular, applied to the angle of rotation or the rotational angular velocity. It is assumed that a run is normal when comparison of the current measurements with the results of a reference run remain within a tolerance. The tolerance can take into consideration the effect of velocity and static and dynamic deviations.

In a special variant of the previously mentioned embodiment, the process is carried out with positional resolution along the track. Thus, it is determined, at different places on the track, which can be arbitrarily close to one another, whether or not the test criterion is met. The angle of rotation or the derived quantity can be determined at arbitrarily short time intervals or continuously during a run.

In another embodiment of the invention, the state value is a difference between at least two angles of rotation, or between at least two quantities derived therefrom, at successive or non-successive articulations. The difference can a difference between amounts. On the other hand, the difference itself can be determined as an amount. The difference can take into consideration the sign, that is the direction, of the angles of rotation, or of the derived quantities. The test criterion can be defined so that the mentioned difference is less than the reference value or the threshold. Here it is assumed that a run is normal when the difference between at least two successive angles of rotation is smaller at any time than the reference value or threshold. The reference value can be recorded during a reference run. Alternatively, the threshold can be assumed. An advantageous variant of this embodiment involves combining it with an embodiment in which the shape of a section of track is determined, as described below. It can be checked whether the difference between angles of rotation (or quantities derived therefrom) in articulations that are located in a section of track of a certain shape, preferably all articulations in such a section of track, lies below a reference value, threshold, or tolerance value. This can involve adapting the reference value, threshold, or tolerance value to the shape of the section of track (according to another embodiment described further below). In particular, if the section of track is arc-shaped, the reference value, threshold, or tolerance value can be selected to be very small. The reason why is that in the case of such a section of track it can be assumed that the articulations located in this section of track have the same deflection in the same direction, that is the same angle of rotation, so that the difference is zero, it being possible to take a small tolerance value as a basis. In the case of an arc-shaped section of track, pairwise differences, or values derived therefrom, are preferably formed between all articulations that are located in this arc-shaped section of track, in particular between adjacent articulations.

Another embodiment of the invention involves defining threshold values of the threshold range, in particular in b-1), as follows:

an upper threshold, which corresponds to a value of a first articulation's angle of rotation, or a quantity derived therefrom, determined at a place on the track during the run of the rail vehicle, plus a tolerance value;

a lower threshold, which corresponds to a value of the first articulation's angle of rotation, or a quantity derived therefrom, determined at the place on the track during the run of the rail vehicle, minus a tolerance value, the test criterion being defined so that the determined angle of rotation, or the quantity derived therefrom, at a second articulation that follows the first articulation, and preferably is the next following articulation, lies within the threshold range, when the second articulation reaches this place on the track during the run of the rail vehicle.

In the previously mentioned embodiment it is assumed that a run is normal if a following articulation experiences a deflection at the same position as the preceding articulation experienced a deflection, this deflection is of the same size as the deflection of the preceding articulation, taking into consideration a tolerance value. The point in time at which the following articulation has reached the same position on the track, and thus the point in time for determining the angle of rotation or the quantity derived therefrom at the second articulation, can be determined from the information travel speed and distance between the articulations, which are known. In this embodiment, the value used as a derived quantity is, in particular, the rotational angular velocity.

In yet another embodiment of the process, the comparison of multiple angles of rotation or multiple quantities derived from the angles of rotation relative to one another involves determining whether the angles of rotation or the quantities derived therefrom have the same sign or a different sign. In particular, this embodiment can be used when the articulations at which the angles of rotation or quantities derived therefrom are determined are located in a curve or in an S-curve. In particular, in an S-curve two articulations are located before and after the point of inflection of the S-curve. Then, a run is normal if, when two such articulations are deflected in the opposite direction, their articulation angles (the amounts of their deflections) do not simultaneously become larger as these articulations continue to travel through the S-curve. This is justified by the fact that two modules cannot, starting from a position in front of and behind the point of inflection, rotate in opposite directions as they continue to travel through the S-curve.

In one embodiment, the process has the further step of:

Determining the shape of a section of track in which the vehicle or one or more successive articulations are located, in particular determining whether the vehicle or one or more successive articulations is/are located on a straight section of track, in a uniform arc, or in an S-curve.

In a variant of this, it is possible for the reference value, threshold, or tolerance value, or a corresponding range, to be adapted to the shape of the current section of track. This adaptation can be performed dynamically, during travel. For example, an embodiment was described above in which the test criterion was defined so that the angle of rotation, or the quantity derived therefrom, was less than the reference value or the threshold. The assumption is, for example, that a run is normal if the change in angle over time is less than the measurement of a reference run or a threshold. For a straight section, there is no change in angle per se, while a change up to a threshold or within a threshold range should be possible. However, this threshold or threshold range is set narrower than in the case of a section of track that is not straight. That is, information about the section of track influences the setting of the threshold (range). Analogously, it is possible to formulate an example for the angle of rotation. The reason why is that during a normal run on a straight section of track all articulations should have no deflection, making it possible to set a narrower threshold or threshold range.

Another example of the variant can make use of the above-mentioned embodiment by using a difference between two angles of rotation at successive articulations as a state value, and defining the test criterion so that the mentioned difference is less than the reference value or threshold. In the case of a constant arc, it should be assumed that a run is normal when all articulations have the same deflection, i.e., the same angle of rotation, in the same direction, so that in the ideal case the difference should be zero, a small difference being tolerable, and a correspondingly narrower threshold is set.

For determining the shape of the section of track there are different variants. First, it is possible to determine, through a distance measurement and a set zero point, for example a beginning of the track, in what section of track, or between what track distances the rail vehicle or its articulations are currently located. Since the shape of the entire track is known, it is possible to determine the shape of the section of track through distance measurement. The distance measurement can be determined by counting the wheel revolutions. In another variant it is possible to determine, through a GPS signal, in what section of track the rail vehicle or a part thereof or articulations thereof is/are located. In yet another variant, it is possible to determine, through sensors next to the track, in what section the rail vehicle is located.

Another embodiment of the process provides that the reference value, threshold, or tolerance value, or a range thereof, be adapted to the travel speed. If the speed is increasing, it is possible, for example, to set these values to be higher or ranges thereof to be narrower. At a higher travel speed it should be assumed, for example, that the rotational angular velocity is greater and also that this is normal. Accordingly, it is possible to set the threshold/reference values (ranges) higher.

Another aspect of this invention relates to a rail vehicle having an analysis device that is set up, in particular programmed, to carry out the process as described above. The analysis device can contain a computer program or program instructions, which cause inventive process steps, at least steps b) and c) to be carried out. The analysis device can be a controller, in particular a vehicle control unit, or a part thereof, or it can be integrated into a controller, in particular a vehicle control unit.

Examples of rail vehicles are, without limitation, locomotives, freight cars, railcars, streetcars, modules. Railroad vehicle parts are, in particular, modules that are assembled into a railroad vehicle. In particular, the railroad vehicle parts are modules of a streetcar. For example, railroad vehicle parts are connected together through a flexible structure, in particular an articulated bellows. The articulation between the railroad vehicle parts is located, in particular, in the bottom area, preferably beneath the floor. Articulations between cars or railroad vehicle parts can additionally be arranged in the area of the roof.

BRIEF DESCRIPTION OF THE DRAWINGS

The invention is described below on the basis of sample embodiments. The figures are as follows.

Quantities and reference numbers that are mentioned in the following examples can be found in the list of reference numbers at the end.

Figure 1:
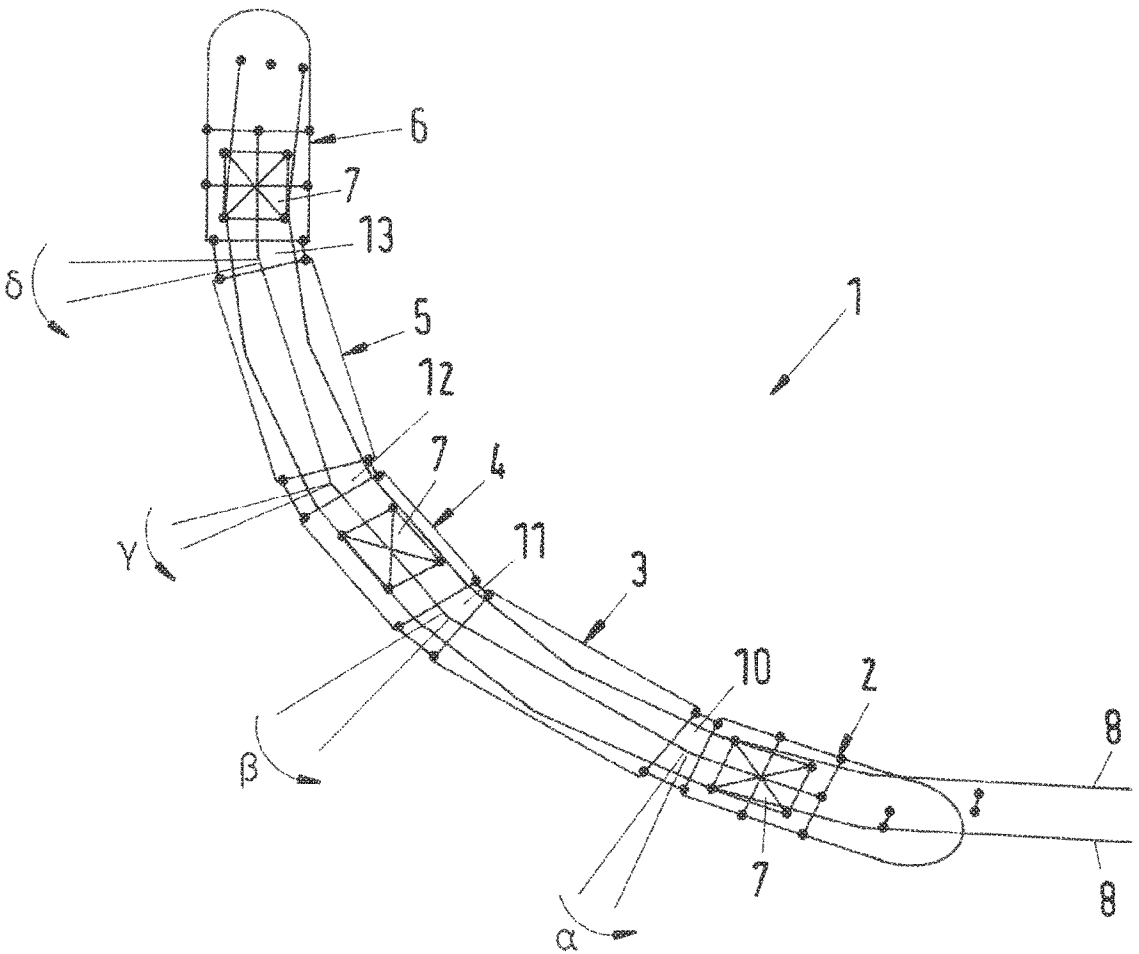
FIG. 1: a rail vehicle in curved position.

FIG. 1 shows the rail vehicle 1 with railroad vehicle parts 2, 3, 4, 5, 6. The modules 2 and 6 are end modules of a streetcar, which In this case represents the rail vehicle. Bogies or chassis are labeled with the reference number 7. The rail vehicle 1 travels on rails 8.

The railroad vehicle parts 2, 3, 4, 5, 6 have the articulations 10, 11, 12, 13 arranged between them. At each articulation an articulation angle α, β, γ, δ has been set.

Figure 2:
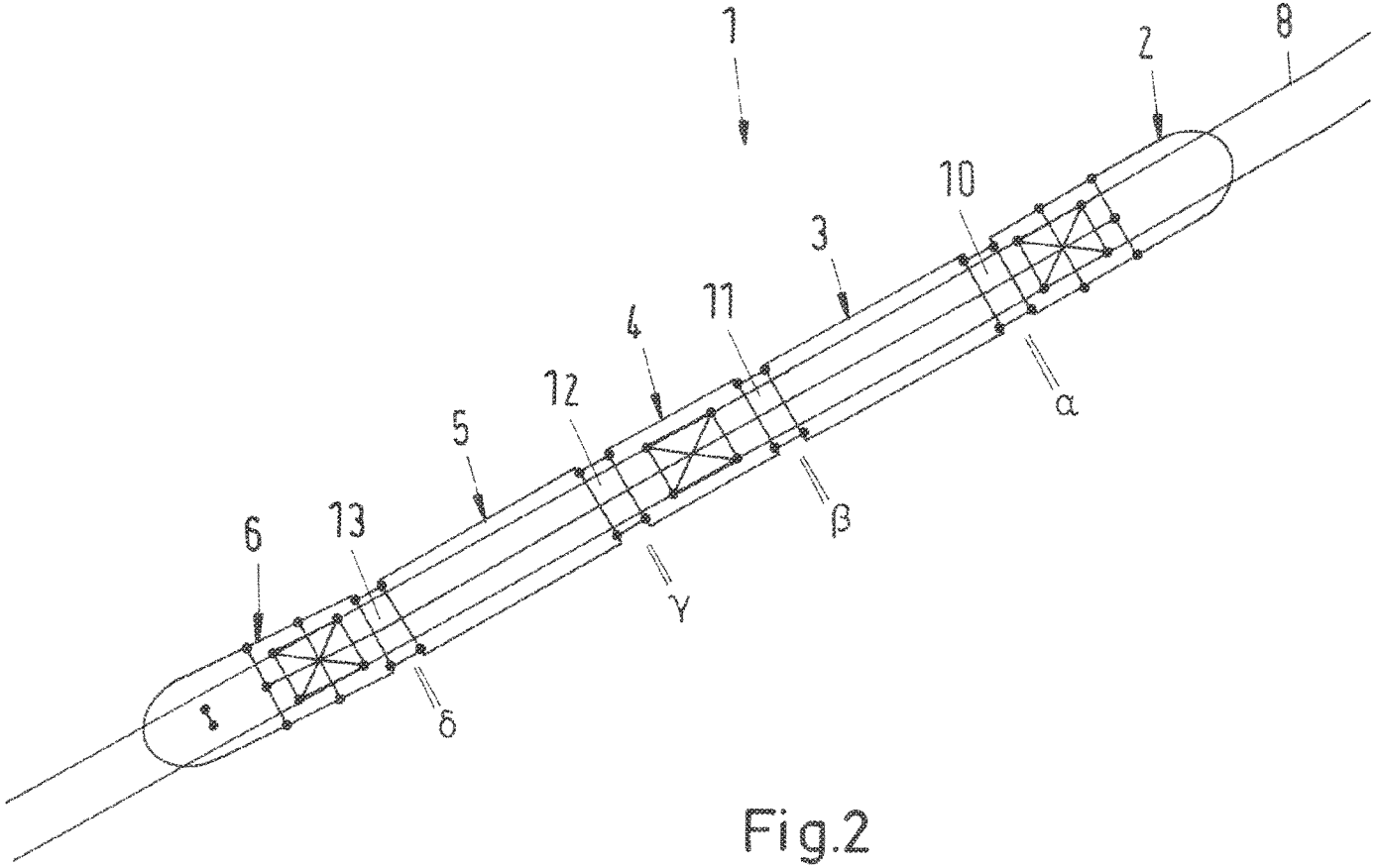
FIG. 2: a rail vehicle in straight position.
Figure 3:
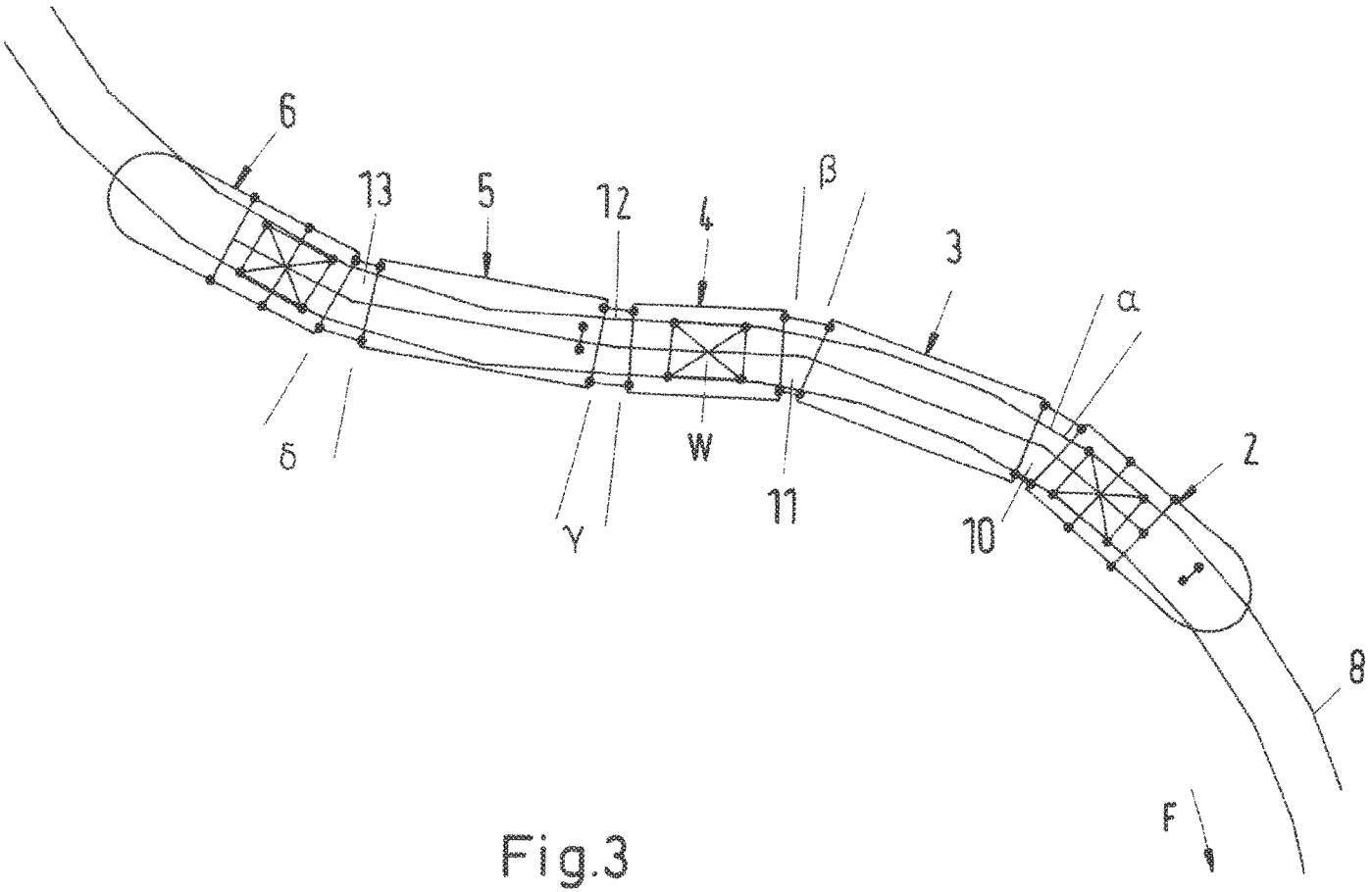
FIG. 3: a rail vehicle in an S-curve.

FIGS. 2 and 3 show the articulations with changed angular position; the same reference numbers are used as FIG. 1.

The inventive process is explained below using sample criteria. The system recognizes "normal travel" and "derailment" on the basis of the criteria A, B, C, D, E, F, G, H, I, J listed below, which can be supplemented, as needed.

A derailment can also be recognized if one or more of these criteria is/are no longer met. The criteria can be general criteria or run-specific criteria. The general criteria A through E can always apply. The additional criteria F through J can be specific for the travel scenarios described below.

Criterion A:

Travel is normal (i.e., free of derailment) if the articulation angle is less than the angle U matching the smallest radius in the rail network (based on geometric track data: radius of the curve)

$$|\theta|<|\theta_{max}|+T$$

$\theta_{max}$ can be recorded during a test run or it can be calculated from the radius and the overall dimensions of the vehicle or it can be measured.

Criterion B:

A run is normal if the change in angle over time is less than the measurement of a reference run or a threshold. A Dirac-shaped change in angle is impossible in normal travel.

$|\theta'_t|<D$ (where $D$ is *a* realistic Dirac value, e.g., $D=7°/s$)

Criterion C:

A run is normal when comparison of the current measurements with the results of a reference run shows that these current measurements remain within a tolerance. The tolerance takes into consideration the effect of speed and static and dynamic deviations . . . ).

$$\theta=\theta_F\pm T$$

$$\theta'_t=\theta'_{tF}\pm T$$

Criterion D:

A run is normal if the difference between two successive articulation angles is smaller at any time than a threshold U. The threshold can be recorded during a reference run or a conservative value can be assumed, e.g., 15°)

$$-U<|\alpha(t_0)|-|\beta(t_0)|<U\forall t_0$$

Criterion E:

A run is normal if a following articulation is deflected at the same position in the rail network as the preceding articulation (can be calculated from speed and overall dimensions of the vehicle)

$$a(t_0)-T<\beta\left(t_0+\frac{d}{v(t0)}\right)<\alpha(t_0)+T$$

Criterion F:

A run is normal if the changes in angle over time of successive articulations are the same at the same position in the rail network $$\alpha'_t(t_0)-T<\beta'_t\left(t_0+\frac{d}{v(t0)}\right)<\alpha'_t(t_0)+T$$

The above-mentioned general criteria, which can always be set as valid in any combination or subcombination, can be supplemented by the following run-specific criteria.

The following criteria are run-specific criteria:

Scenario 1: Straight Track (with Reference to FIG. 2):

A derailment is present on a straight track if one or more of the following criteria is/are not met:

Criterion G:

A run is normal if all articulations have no deflection $|\theta(t)|<T$ (e.g., $T=4°$)

Criterion H:

A run is normal if there is no angular velocity in the articulation $|\theta'_t|<T$ (e.g., $T=3°/s$)

Scenario 2: Constant Arc (with Reference to FIG. 1)

Additional run-specific detection criterion:

Criteria I:

A run is normal when all articulations have the same deflection in the same direction (within a given tolerance):

$\alpha=\beta\pm T$, $\beta=\gamma\pm T$, $\gamma=\delta\pm T$ (e.g., $T=\pm 4°$)

Scenario 3: S-Curve (with Reference to FIG. 3):

Additional run-specific detection criterion:

Criterion J:

The articulation 11 is located after the point of inflection W of the S-curve in the direction of travel F (that is, it has already passed the point of inflection), while the articulation 12 is still located before the point of inflection W. The successive articulations 11, 12 have opposite deflections (positive and negative).

A run is normal if the absolute values of two articulation angles (e.g., $|\alpha|$ and $|\beta|$) do not simultaneously become greater (i.e., two modules cannot rotate in opposite directions in a normal S-curve).

The following algorithm can then be used, for example:

IF($\alpha*\beta<0$) AND ($\alpha'_t*\beta'_t<0$) THEN . . . criterion *J* is not met (i.e., derailment is detected)

Figure 4:
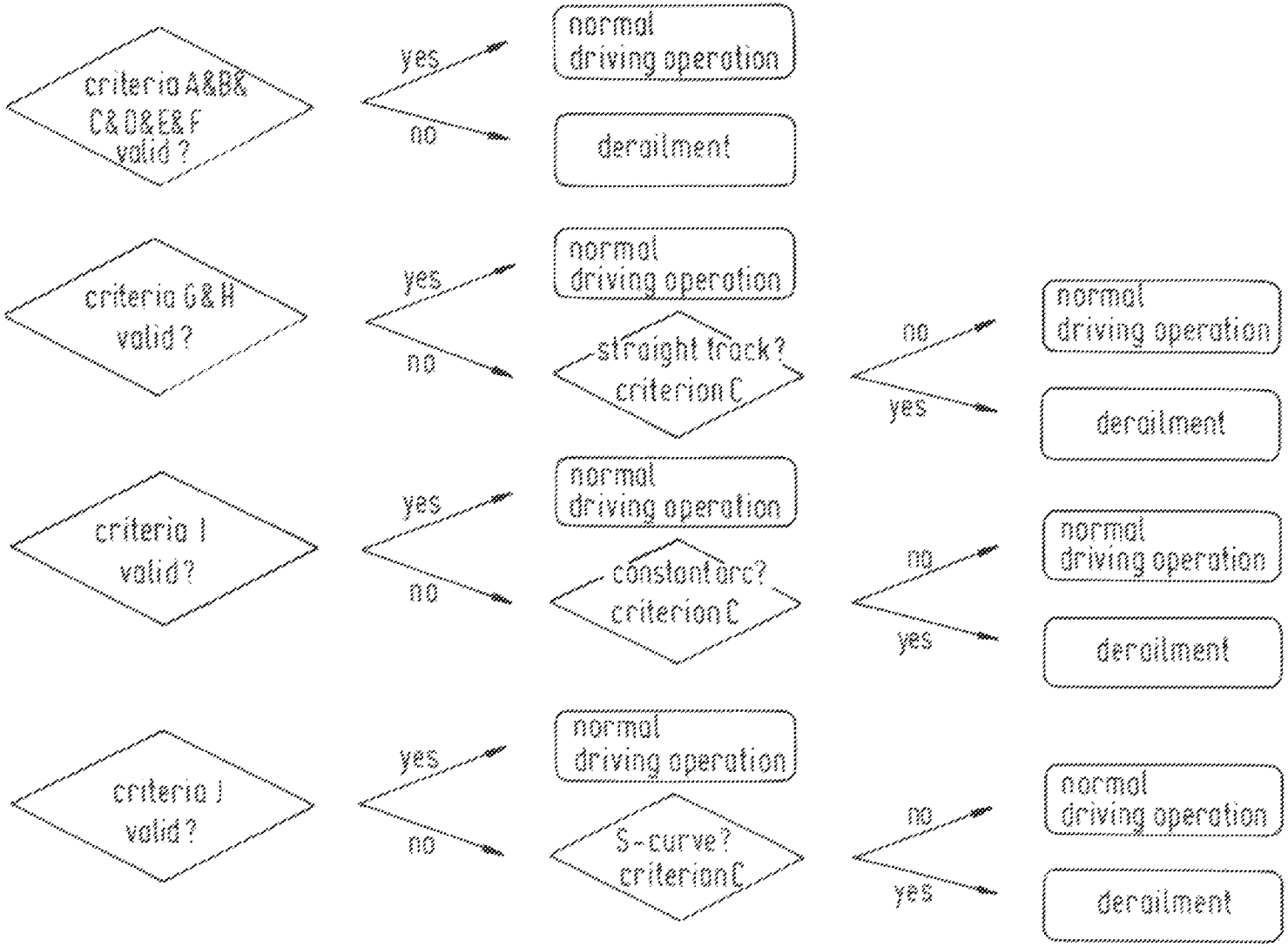
FIG. 4: a process sequence.

FIG. 4 is a process flow chart. The testing of criteria A-F is independent of the shape of the track. It is not necessary to test all criteria A-F, as is shown here, but rather it is also possible to test any selection of one or more of these criteria. If the criterion is met, a run is normal, e.g., free of derailment in this example. If the criterion is not met, there is a derailment. If multiple criteria are tested, there is redundant testing, and the yes/no result can be strengthened.

The above-described criteria G, H, I, and J involve additionally testing, in another step, whether the vehicle or articulations that are being considered are located on a straight track (criteria G and H), whether they are located in a constant arc, or whether they are located in an S-curve. Here the shape of the track is tested by criterion C. That is, the angle of rotation or the rotational angular velocity is compared with measurements of the angle of rotation or the rotational angular velocity from a reference run on the same track, preferably at all articulations, and from this comparison it is possible to determine the current shape of the track. However, the shape of the track need not be determined on the basis of criterion C, but rather can also be done in another way, as previously indicated in the general description.

LIST OF REFERENCE NUMBERS

1 Railroad vehicle

2,3,4,5,6 Railroad vehicle part

7 Bogie

8 Rails

10,11,12,13 Articulations

F Direction of travel

W Point of inflection of an S-curve $\alpha,\beta,\gamma,\delta$ Articulation angle (depends on the number of modules)

$\theta$ Articulation angle in every articulation, general term for $\alpha,\beta,\gamma,\delta$ . . . if the conditions are simultaneously satisfied for every articulation angle $\alpha'_t$, $\beta'_t$, $\gamma'_t$, $\delta'_t$, $\theta'_t$ angular velocities $$\theta'_t(t_0)=\frac{\theta(t_0+\varepsilon)-\theta(t_0)}{\varepsilon}$$

where the term $\varepsilon$ in the above expression $$\frac{\theta(t0+\varepsilon)-\theta(t0)}{\varepsilon}$$

corresponds to the time sampling of the sensor.

U Reference threshold

T Tolerance t Time $t_0$ Reference time point d Distance between articulations (module lengths)

$v(t_0)$ instantaneous velocity of the vehicle

F Subscript. Means that the value was determined in a reference run (e.g., $\alpha_F$, $\theta'_{tF}$ . . . )

The invention claimed is:

1. A process for detecting a derailment of a rail vehicle having two or more rail vehicle parts and one or more articulations through which adjacent rail vehicle parts are rotatably connected with one another, the process comprising:

a) determining a-1) an angle of rotation between adjacent rail vehicle parts, and/or a quantity derived from the angle of rotation; or a-2) multiple angles of rotation or multiple quantities derived from the angles of rotation between different adjacent rail vehicle parts, b) comparing b-1) the angle of rotation or the derived quantity from a-1) or multiple angles of rotation or derived quantities from a-2) with at least one reference value or threshold, or with at least one reference value range or threshold range; and/or b-2) multiple angles of rotation or the multiple quantities from a-2) derived from the angles of rotation, relative to one another; and/or b-3) a state value that is determined from multiple angles of rotation or multiple quantities from a-2) derived from the angles of rotation with at least one reference value or threshold, or with at least one reference value range or threshold range, a test criterion indicating whether or not there is a derailment, this test criterion being defined based on:

the at least one reference value or threshold, the reference value range, and/or the threshold range in b-1) or b-3), and/or an expected relationship of multiple angles of rotation, and/or an expected relationship of the multiple quantities from b-2) derived from the angles of rotation, relative to one another, and c) determining whether or not the test criterion is met and whether a derailment is happening or has happened, or is not happening or has not happened, wherein the threshold is an angle of rotation matching a minimum radius of a curve, and the test criterion is defined so that the angle of rotation is less than the threshold.

2. The process according to claim 1, wherein the derived quantity is a rotational angular velocity and/or a rotational angular acceleration.

3. The process according to claim 1, further having one or more of the following steps if it is found that the derailment is occurring or has occurred:

producing a derailment situation signal if it has been determined that the derailment is occurring or has occurred;

outputting a warning or a distress signal about the derailment;

sending a message about the derailment to a control center or a rescue center; and emergency braking or other braking of the rail vehicle.

4. The process according to claim 1, wherein multiple angles of rotation or multiple quantities derived from these angles of rotation are determined at different articulations.

5. The process according to claim 1, wherein the at least one reference value or threshold and/or the reference value range or the threshold range are or have been determined from a reference run of the rail vehicle on an equal section of a track, or on a same section of the track.

6. The process according to claim 5, wherein value limits of the reference value range are defined as follows:

an upper reference value, which corresponds to a value of an angle of rotation, determined during the reference run of the rail vehicle, or a quantity derived therefrom, plus a tolerance value, and lower reference value, which corresponds to the value of an angle of rotation determined during the reference run of the rail vehicle, or a quantity derived therefrom, minus a tolerance value, and wherein the test criterion is defined so that the determined angle of rotation, or the quantity derived from the determined angle of rotation lies within the reference value range.

7. The process according to claim 1, wherein the test criterion is defined so that the angle of rotation or the quantity derived therefrom is less than the reference value or threshold.

8. The process according to claim 1, wherein the process is carried out with positional resolution along the track.

9. The process according to claim 1, wherein the state value is a difference between at least two angles of rotation or between at least two quantities derived therefrom at successive or non-successive articulations.

10. The process according to claim 1, wherein value limits of the threshold range are defined as:

an upper threshold, which corresponds to a value of a first articulation's angle of rotation or a quantity derived therefrom, determined at a place on the track during the run of the rail vehicle, plus a tolerance value, a lower threshold, which corresponds to a value of the first articulation's angle of rotation, or a quantity derived therefrom, determined at the place on the track during the run of the rail vehicle, minus a tolerance value, the test criterion being defined so that the determined angle of rotation, or the quantity derived therefrom, at a second articulation that follows the first articulation, lies within the threshold range, when the second articulation reaches this place on the track during the run of the rail vehicle.

11. The process according to claim 1, wherein the comparison of multiple angles of rotation or multiple quantities derived from the angles of rotation relative to one another involves determining whether the angles of rotation or the quantities derived therefrom have a same sign or a different sign.

12. The process according to claim 1, further comprising:

determining a shape of a section of track in which the vehicle or one or more successive articulations are located.

13. The process according to claim 12, wherein the at least one reference value or threshold, the tolerance value, or a range thereof are adapted to the shape of the section of the track.

14. The process according to claim 1, wherein the at least one reference value or threshold, the tolerance value, or a range thereof are adapted to a travel speed.

15. A rail vehicle having an analysis device that is set up to carry out the process according to claim 1.

* * * * *